US009609963B1

(12) United States Patent
Ratnow

(10) Patent No.: US 9,609,963 B1
(45) Date of Patent: Apr. 4, 2017

(54) APPARATUS AND METHOD FOR STORING AND DISPLAYING MEMORABILIA

(71) Applicant: Lisa Ansorge Ratnow, Downingtown, PA (US)

(72) Inventor: Lisa Ansorge Ratnow, Downingtown, PA (US)

( * ) Notice: Subject to any disclaimer, the term of this patent is extended or adjusted under 35 U.S.C. 154(b) by 0 days.

(21) Appl. No.: 14/997,570

(22) Filed: Jan. 17, 2016

(51) Int. Cl.

| | |
|---|---|
| ***D05C 1/02*** | (2006.01) |
| ***A47G 1/12*** | (2006.01) |
| ***A47G 1/06*** | (2006.01) |
| *D05C 9/12* | (2006.01) |
| *D05C 1/04* | (2006.01) |
| *D05C 9/04* | (2006.01) |

(52) U.S. Cl.
CPC ..... *A47G 1/12* (2013.01); *A47G 1/065* (2013.01); *A47G 2001/0677* (2013.01); *D05C 1/02* (2013.01); *D05C 1/04* (2013.01); *D05C 9/04* (2013.01); *D05C 9/12* (2013.01)

(58) Field of Classification Search
CPC . A47G 1/065; A47G 1/12; A47G 1/06; B44D 3/185; D05C 1/02; D05C 9/04; D05C 1/04; D05C 9/12; D06C 3/08; G09F 15/0025; G09F 17/00; G09F 7/18; G09F 15/0018
USPC ..... 38/102.2; 40/606.01
See application file for complete search history.

(56) References Cited

U.S. PATENT DOCUMENTS

| | | | | | |
|---|---|---|---|---|---|
| 2,957,269 | A * | 10/1960 | Nohl | D05C 1/04 | 38/102.2 |
| 3,818,620 | A * | 6/1974 | Field | D05C 1/04 | 38/102.2 |
| 4,030,220 | A * | 6/1977 | Kotchen | G09F 1/12 | 38/102.91 |
| 4,422,250 | A * | 12/1983 | Golan | D05C 1/04 | 38/102.2 |
| 4,451,997 | A * | 6/1984 | Jones | D05C 1/02 | 160/380 |
| 4,485,574 | A * | 12/1984 | Bennetot | D05C 9/04 | 112/103 |
| 4,726,130 | A * | 2/1988 | Bussard | D05C 1/04 | 38/102.2 |
| 4,991,329 | A * | 2/1991 | Wilson | A47G 1/06 | 160/380 |
| 6,868,626 | B1 * | 3/2005 | Linkous | D05C 1/04 | 38/102.91 |
| 7,458,174 | B1 * | 12/2008 | Gustin | D05C 1/02 | 38/102.2 |
| 7,918,169 | B2 * | 4/2011 | Mack | B25B 11/002 | 112/103 |
| 9,296,552 | B2 * | 3/2016 | Schleuning | B65D 85/182 | |
| 9,532,669 | B2 * | 1/2017 | Schoeler | A47G 1/12 | |

* cited by examiner

*Primary Examiner* — Shin Kim
(74) *Attorney, Agent, or Firm* — Henry I. Schanzer, Esq

(57) ABSTRACT

Apparatus and method for storing and displaying memorabilia include a base tray/enclosure for holding display modules which are to be mounted in the enclosure. Each display module includes a "display mount", designed to have an item to be displayed mounted thereon, and a securing device to secure the item to be displayed to the display mount. The securing device is designed to secure the display item to the display mount without the need for any external tools. This enables the item to be displayed to be easily attached to the display mount, or to be detached from the display mount.

11 Claims, 9 Drawing Sheets

APPARATUS AND METHOD FOR STORING AND DISPLAYING MEMORABILIA

BACKGROUND OF THE INVENTION

This invention relates to apparatus and method for storing and displaying memorabilia.

By way of example, new mothers have sentimental attachment to various memorabilia pertaining to their children's early days. The type of memorabilia is virtually limitless and may include, for example, a favorite outfit, a crib sheet, or a receiving blanket. Lacking an organized system for saving and/or storing, these cherished items end up in a pile with other clothes that are too small or no longer of functional use. It is emotionally uncomfortable for a new mother to throw them out. An alternative is to put these items in unwieldy storage boxes. It is therefore desirable for mothers and fathers) to be able to easily organize, store and display these objects, or portions of these cherished objects, of historical and emotional interest in the development of their children from their birth, onwards.

Currently, there is no known system for easily mounting and displaying multiple pieces of memorabilia, such as fabric, in a framed collage. Known systems include the need to permanently attach pieces of fabric to a frame and/or require the use of somewhat complex arrangements to store and display the mementos.

There is therefore a need for busy individuals (e.g., new mothers) to be able to quickly and easily arrange for the display of these sentimental memorabilia (e.g., pieces of fabric) so they can continue to be enjoyed in the future.

SUMMARY OF THE INVENTION

In accordance with the invention, apparatus and method for storing and displaying memorabilia include a base tray/enclosure for holding display modules which are to be mounted in the enclosure. Each display module includes a "display mount" and a securing device. The display mount is designed to have an item to be displayed mounted thereon. The securing device is designed to secure the item to be displayed to the display mount. The securing device is structured to mount along a portion of the outer side surface of the display mount. The securing device is designed to secure the display item to the display mount without the need for any external tools. This enables the item to be displayed to be easily attached to the display mount, or to be detached from the display mount.

BRIEF DESCRIPTION OF THE DRAWINGS

In the accompanying drawings, which are not drawn to scale, like reference characters denote like components.

DETAILED DESCRIPTION OF THE DRAWINGS

Figure 1:
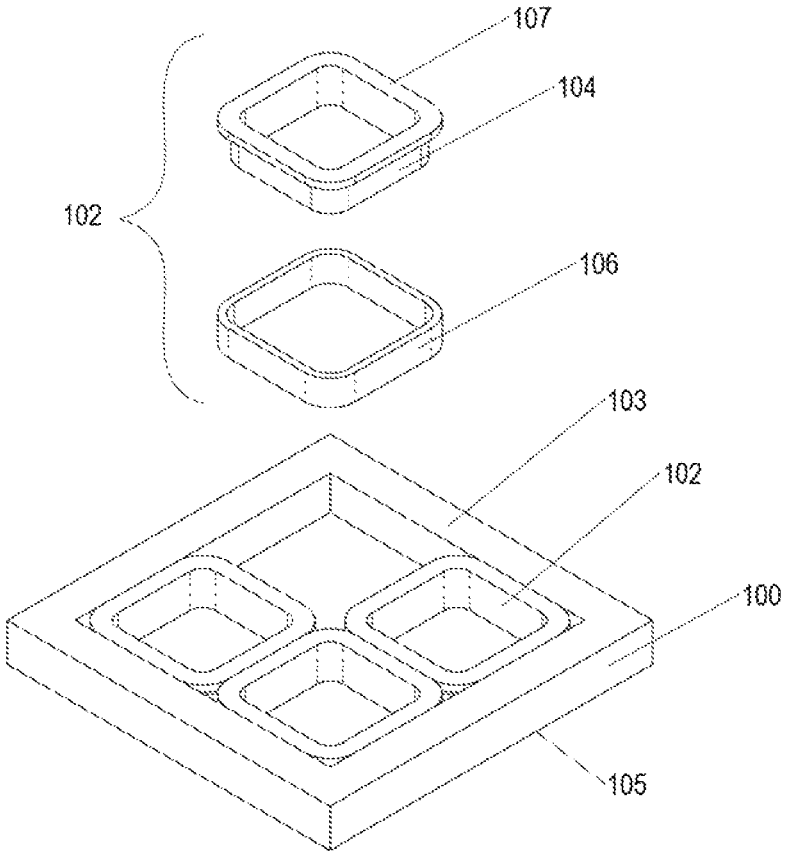
FIG. 1 is an isometric and exploded view of one embodiment of the invention.
Figure 5:
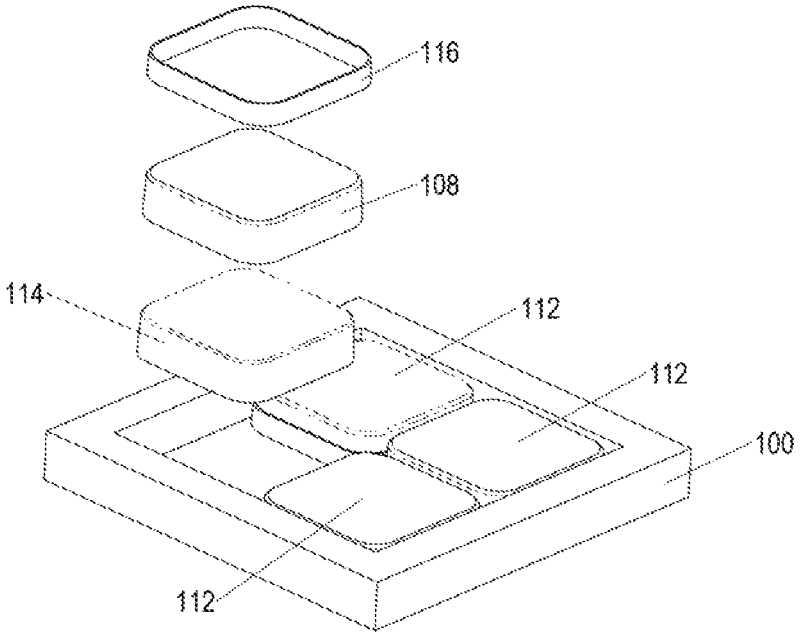
FIG. 5 is an isometric and exploded view of another embodiment of the invention.
Figure 6:
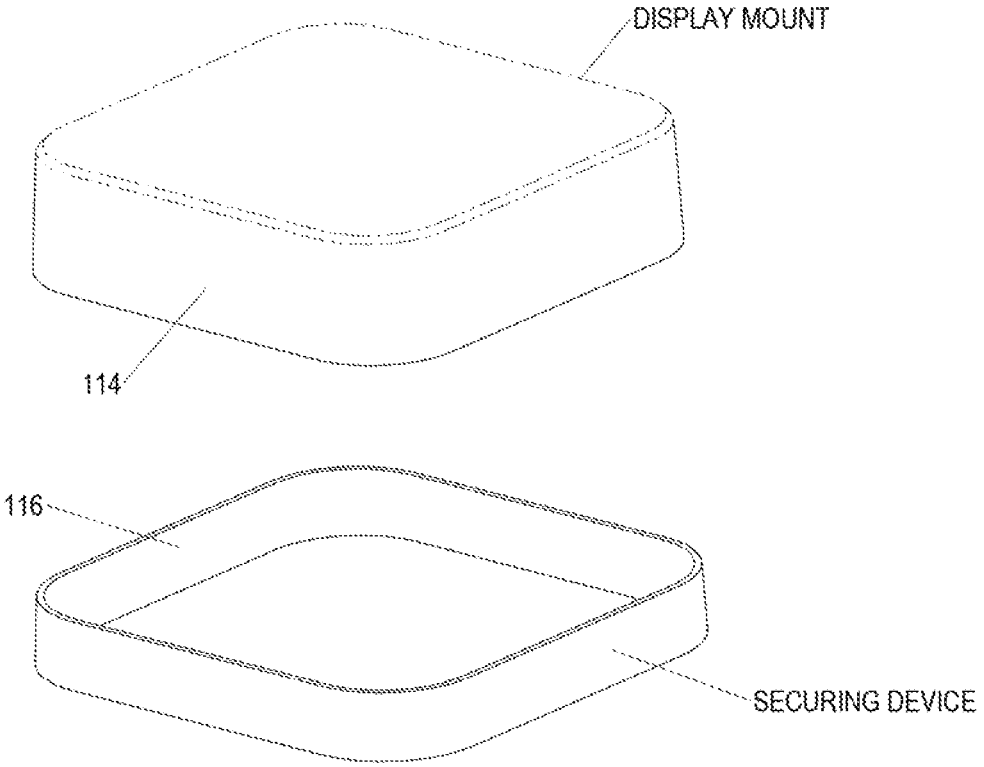
FIG. 6 is a detailed view of the display mount and securing device which are shown in FIG. 5.

Referring to FIG. 1, there is shown a display tray 100 in which are located display modules 102. The tray has an outer wall 103 and a base 105 to form an enclosure for modules 102. The modules 102 can be easily placed within the enclosure and/or removed from the enclosure. As detailed in the exploded view accompanying FIG. 1 and in the cross sectional diagram of FIG. 2, each display module 102 includes a display mount 104 and a securing ring 106. Each display mount 104 is formed to define a horizontal surface along which an item to be displayed is intended to be positioned and a vertical portion along which the item to be displayed can be draped and secured. The vertical portion is generally perpendicular to the horizontal surface and provides the support for the horizontal surface. One type of display mount 104 is shown in FIGS. 1 and 2 and another type of display mount 114 is shown in FIGS. 5 and 6.

Figure 2:
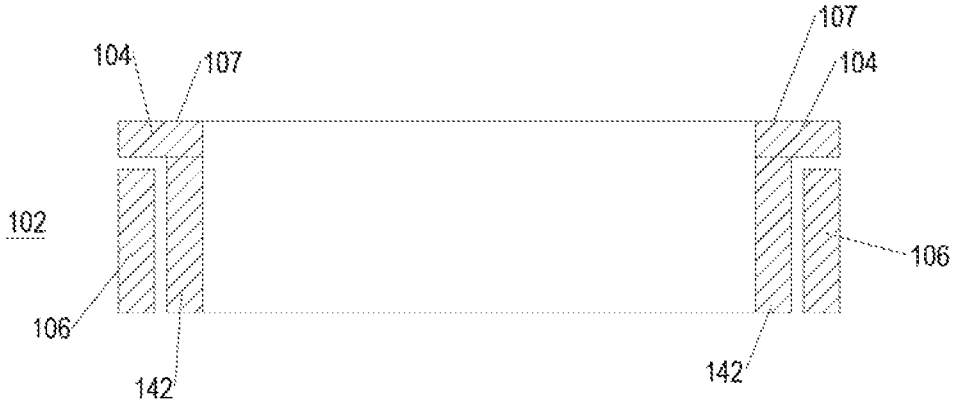
FIG. 2 is a cross sectional view of a display module embodying the invention.

In FIG. 2, the display mount 104, when viewed in cross section, has a general T-like configuration with a hollowed out central core. The structure of the display mount 104 may also be described as having, in cross section, a generally inverted L-shaped tubular configuration. The horizontal portion (107) of the outer wall of the display mount extends beyond the vertical portion 142. This enables a securing device 106 to be nested along the vertical portion of the outer wall of the display mount.

Figure 3:
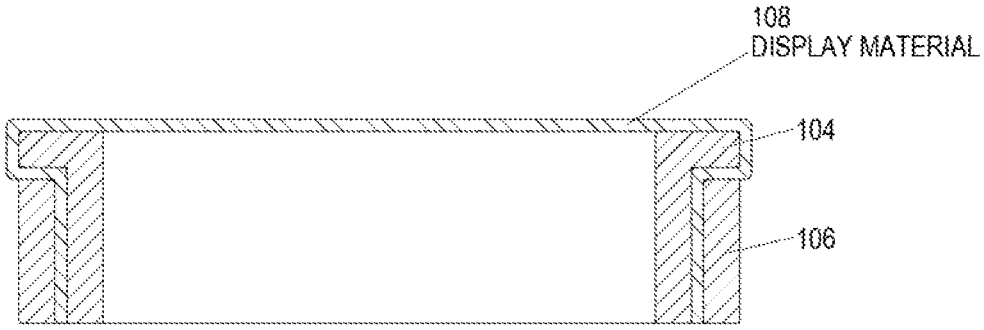
FIG. 3 is a cross sectional view of a display module with a display element mounted hereon.

FIG. 3 shows a sample display material 108 overlying the top horizontal surface of display mount 104 with the display material 108 draped along the sides (i.e., the vertical portion) of the display mount. The securing ring 108 functions as a wedge to hold the display material 108 securely against the vertical portions of the inverted-L and maintains the material along the surface of the display mount in tension to ensure a secure and neat display.

The display mount 104 may be made of any suitable material such as wood, metal or plastic which provides sufficient rigidity and strength to maintain the structural integrity of the display mount. In FIGS. 1, 2 and 3 the display mount is shown to have a hollowed out core. This makes the device lighter and cheaper to manufacture. However, it should be understood that it could be a solid piece. In FIGS. 1, 2 and 3, the top, horizontal, surface of the display mount is shown to have a square shape. However, it should be understood that the top surface could also be circular or rectangular or have any arbitrary shape (e.g., scalloped) designed to enhance the item to be displayed.

The securing device 106 may be any device or ring which in conjunction with its corresponding display mount can hold the display material/item securely in place. In FIGS. 1, 2 and 3, the securing ring is of similar material to the display mount and shaped in a complementary fashion to that of the vertical portion of the inverted L-shaped walls of the display mount. However, it should be understood that the securing device 106 may be any device such as a rubber band or a strip of Velcro, or any strip of material, which can be wrapped around the display material draped around the vertical portion of the display mount to secure the item being displayed.

The display item 108 may be a fabric (e.g., of a baby blanket or baby outfit or the like) or any object or material that can be mounted on the display mount for viewing.

A method of using the display tray 100 and display module(s) 102 includes taking an item, such as a piece of a baby blanket, mounting it over a display mount 104 and draping it along the sides of the display mount. Parts of the selected piece of material which hang down beyond the vertical sides of the display mount can be cut off. The piece of material can thus be tailored (cut and/or shaped) and then secured to the display mount. The securing may be achieved, by way of example, by sliding a securing ring 106 over the portion of the display item along the vertical sides of the display mount. The shape, size and material of the securing ring is selected to enable a secure (e.g., wedging) attachment. The display item 108 is thus securely attached to the display mount. Note that no external tools are required to attach the display item to the display mount and that its integrity is maintained. Note also that, subsequently, no external tools are needed to detach or remove the display item and replace it with another selected display item. After a module 102 is completed with its display item, the module can be placed in, and arranged on, a display tray 100 in any selected manner. The modules can be easily placed in the tray, or removed and/or arranged in any particular order.

Figure 4:
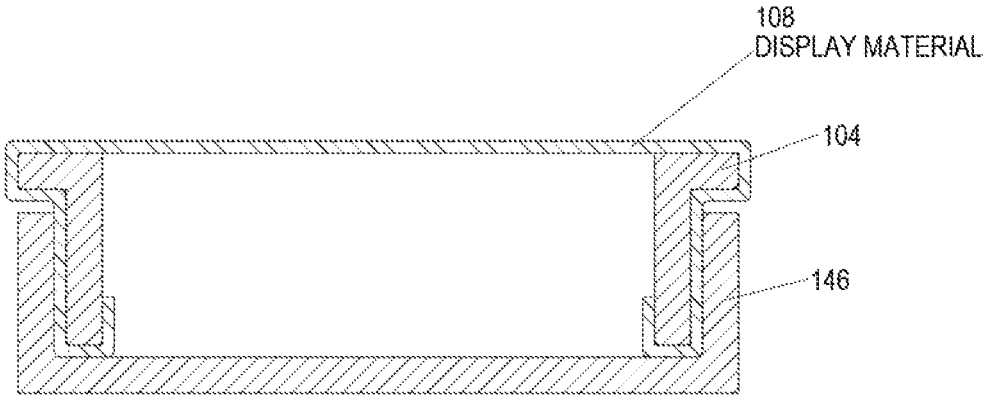
FIG. 4 is a cross sectional view of another display module embodying the invention.

FIG. 4 shows the display material 108 wrapped around the vertical portion of the display mount and extending within the hollowed-out core. Note that a cup-shaped securing device 146 may be used to secure the bottom portion of the display material to the display mount. Alternatively, a securing device such as 106, shown above, can be used instead.

FIG. 5 shows a tray 100 in which are located display modules 112 and an exploded view of one of these modules including a display item. Each module 112 includes a display mount 114 and a securing device 116. Display mount 114 is functionally equivalent to display mount 104 and securing device 116 is functionally equivalent to securing device 106. As further detailed in FIG. 6, the display mount 114 may be referred to as an inner cap and the securing device 116 is an outer ring which can "encircle" the exterior perimeter of the inner cap 114. In this embodiment the display mount 114 has a solid horizontal surface along its full length and width and vertical sides extending generally in a perpendicular direction from the outer edge of the horizontal surface. Note that the vertical support could be legs or it could be a solid stud formed under the horizontal surface forming a mushroom like or table like configuration.

Figure 7:
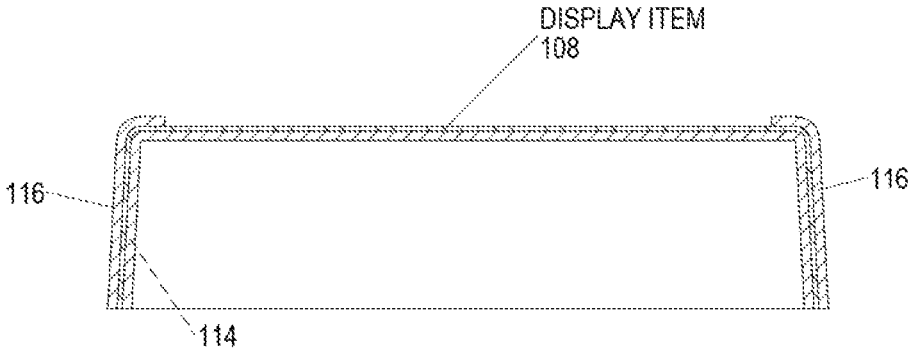
FIG. 7 is a cross sectional diagram of a display item mounted on the display mount of FIG. 5 or 6 and secured by the securing device of FIG. 5 or 6.

FIG. 7 is a cross-sectional diagram illustrating the positioning of a display item 108 over the display mount 114 and a securing device 116 wedging the display item against the display mount and hold ing it in place.

Figure 8:
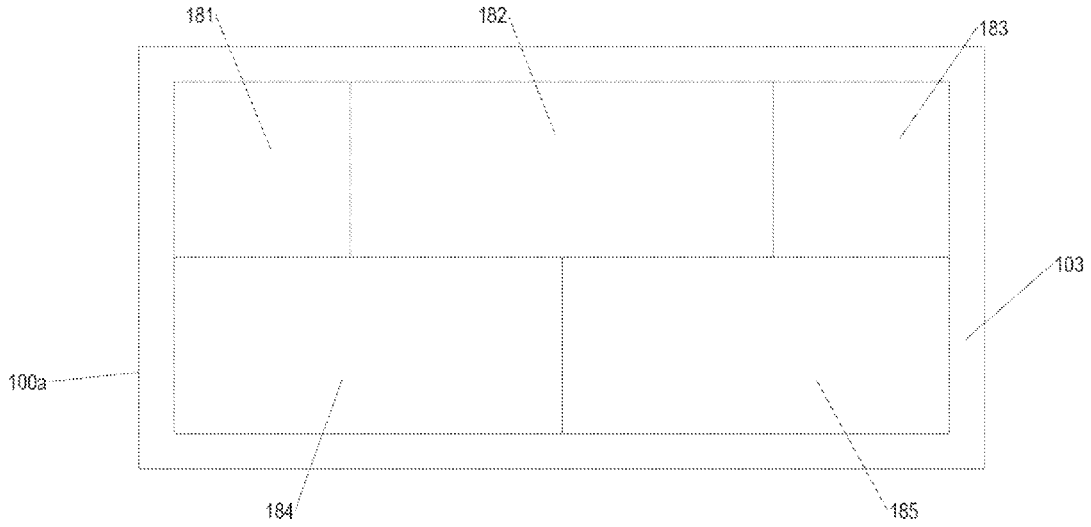
FIG. 8 is a top view of a display tray 100*a* illustrating different sized and shaped modules.

FIG. 8 is a top view of a display tray 100*a* illustrating that different shaped and sized display modules (e.g., 181, 182, 183, 184, 185) may be used to practice the invention. For example, modules 181 and 183 are generally square shaped. Modules 182, 184 and 185 are rectangular shaped modules which may be of different sizes. It should be understood that the horizontal surface of the display mounts may have any suitable shape. That is, the horizontal surfaces of the "display mounts" may be rectangular, square, triangular (or any polygon) or irregular in shape (e.g., scalloped).

Figure 9:
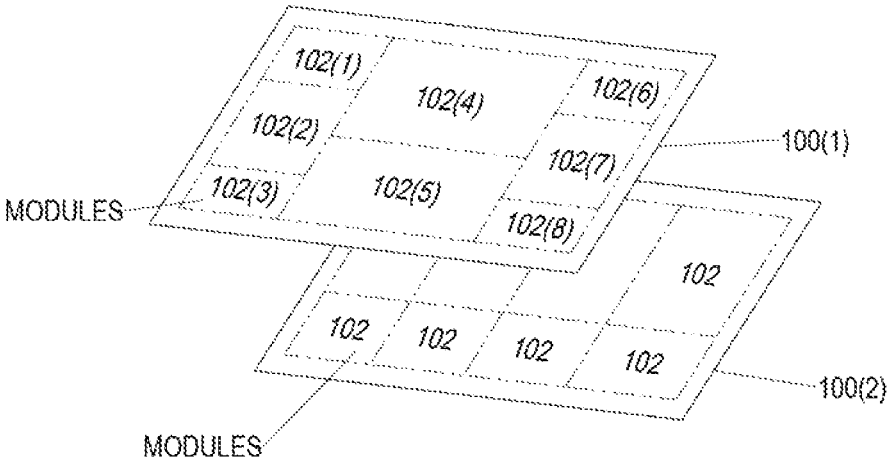
FIG. 9 is an isometric view of two trays showing that the display trays can be stacked on top of each other for compact storage and ease of display.

FIG. 9 is an isometric view illustrating that a number of different display trays [100(1), 100(2)] can be formed, each tray containing selected memorabilia and that these trays can be stacked one on top of the other to provide compact storage and ease of display. The trays may be arranged, for example, to reflect a chronological order or any selected order or scheme.

The horizontal and vertical dimensions of the display tray may range from less than 5 inches to more than 15 inches. The thickness (height) of a display tray may range from less than an ½ inch to more than 3 inches. The horizontal and vertical dimensions of a display mount may range from less than 2 inches to more than 12 inches. The thickness (height) of each module may range from less than an ½ inch to more than 3 inches.

Display trays with an assortments of display modules of same shapes or of different shapes can be packaged in kit perform. A variety of different shaped display mounts (e.g., which can be limitless or as shown in FIG. 8) and a variety of security devices (e.g., pre-shaped encircling rings, rubber bands, Velcro strips) can be packaged to form kits which can be used to form display trays, containing a variety of cherished display items, quickly and easily.

What is claimed is:

1. Apparatus for displaying memorabilia comprising:

a base enclosure for holding and displaying selected display modules;

each display module including a display mount and a securing device;

each display mount defining a horizontal surface and having vertical sides extending from the horizontal surface for mounting the display mount within said base enclosure, said display mount being designed for the positioning of a display item, constituting said memorabilia, along said horizontal surface of said display mount; and said securing device for securing the display item to the display mount.

2. Apparatus for displaying memorabilia as claimed in claim 1 wherein said base enclosure is display tray; wherein said display item extends along and drapes the vertical sides of the display mount; and wherein said securing device is structured to overlie the display item and encircle the vertical sides of said display mount to securely hold the display item in place.

3. Apparatus for displaying memorabilia as claimed in claim 2 wherein the securing device can be selectively removed to enable the display item to be removed and replaced with a different display item.

4. Apparatus for displaying memorabilia as claimed in claim 1 wherein the display mount has an inverted L-shaped cross section, the display mount being designed to have a display item laid out along the top horizontal surface including the horizontal portion of the inverted L-shaped display mount and said display item extending along the vertical sides of the inverted L-shaped display mount; and w herein the securing device fits around the portion of the display item hanging along the vertical portion of the display mount to secure the display item to the display mount.

5. Apparatus for displaying memorabilia as claimed in claim 2, wherein at least three display mounts are located within the display tray.

6. Apparatus for displaying memorabilia as claimed in claim 1 wherein the display modules are designed to abut each other and to fit in and fill the base enclosure.

7. Apparatus for displaying memorabilia as claimed in claim 1 wherein each display mount has a horizontal surface extending the full length and width of the display mount and vertical sides extending downward in a general perpendicular direction to the horizontal surface; wherein a display item can be laid out along the top horizontal surface with portions of the display item draped along the vertical sides of the display mount; and wherein the securing device fits around the portion of the display item draped along the vertical portion of the display mount to secure the display item to the display mount.

8. Apparatus for displaying memorabilia as claimed in claim 1 wherein the horizontal surface of each display mount is a polygon.

9. Apparatus for displaying memorabilia as claimed in claim 1 wherein at least two display modules are located within the base enclosure.

10. Apparatus for displaying memorabilia as claimed in claim 2, further including an additional tray, with each tray being configured to enable trays to be stacked one on top of the other.

11. A kit for storing and displaying items to be displayed comprising:

a display tray for storing a selected number of display modules;

each display module including a display mount for the mounting thereon of an item to be displayed and a securing device for holding and securing the item to be displayed to the display mount;

the display mount having structure defining a horizontal surface and having a vertical portion disposed generally in a perpendicular direction to the horizontal surface;

said display mount being designed to enable an item to be displayed to be laid out along said horizontal surface and to be draped along said vertical portion; and said securing device being structured to enable the securing without requiring additional tools.

* * * * *